US006119897A

United States Patent [19]

Boileau

[11] Patent Number: 6,119,897

[45] Date of Patent: Sep. 19, 2000

[54] DISTRIBUTION RECEPTACLE FOR A FLUID PRODUCT COMPRISING A BOTTLE EQUIPPED WITH A DISTRIBUTION DEVICE CONNECTED TO A DIP TUBE

[75] Inventor: Béatrice Boileau, Le Neubourg, France

[73] Assignee: Valois S.A., Le Neubourg, France

[21] Appl. No.: 09/274,607

[22] Filed: Mar. 23, 1999

[30] Foreign Application Priority Data

Mar. 24, 1998 [FR] France ..... 98 03591

[51] Int. Cl.[7] ..... B67D 5/40; B65D 83/15

[52] U.S. Cl. ..... 222/78; 222/382; 222/402.1; D7/300.2

[58] Field of Search ..... D7/300.2; 222/78, 222/211, 382, 464.1, 321.9, 383.1, 385, 402.1

[56] References Cited

U.S. PATENT DOCUMENTS

| | | | |
|---|---|---|---|
| D. 334,503 | 4/1993 | Neubert, Sr. | D7/300.2 |
| 1,916,646 | 7/1933 | Tycko | 239/33 |
| 3,658,215 | 4/1972 | Ewald . | |
| 4,212,332 | 7/1980 | Kutik . | |
| 4,475,667 | 10/1984 | Ori et al. . | |
| 5,649,649 | 7/1997 | Marelli | 222/321.9 X |
| 5,915,600 | 6/1999 | Bitton | 222/464.1 |

FOREIGN PATENT DOCUMENTS

| | | |
|---|---|---|
| 37 10 788 A1 | 11/1988 | Germany . |
| 2 212 222 | 7/1989 | United Kingdom . |

*Primary Examiner*—Kenneth Bomberg
*Attorney, Agent, or Firm*—Rockey, Milnamow & Katz, Ltd.

[57] ABSTRACT

Distribution receptacle for a fluid product comprising a bottle provided with a neck on which a distribution device is fitted, the distribution device being provided with a dip tube that extends towards the bottom of the bottle to supply liquid to the distribution device, characterized in that the bottle is made of a transparent or translucid material and in that the dip tube is surrounded by a decorative tube over at least part of its length, a longitudinal hole being formed through the decorative tube through which the dip tube passes.

5 Claims, 1 Drawing Sheet

Figure 1:
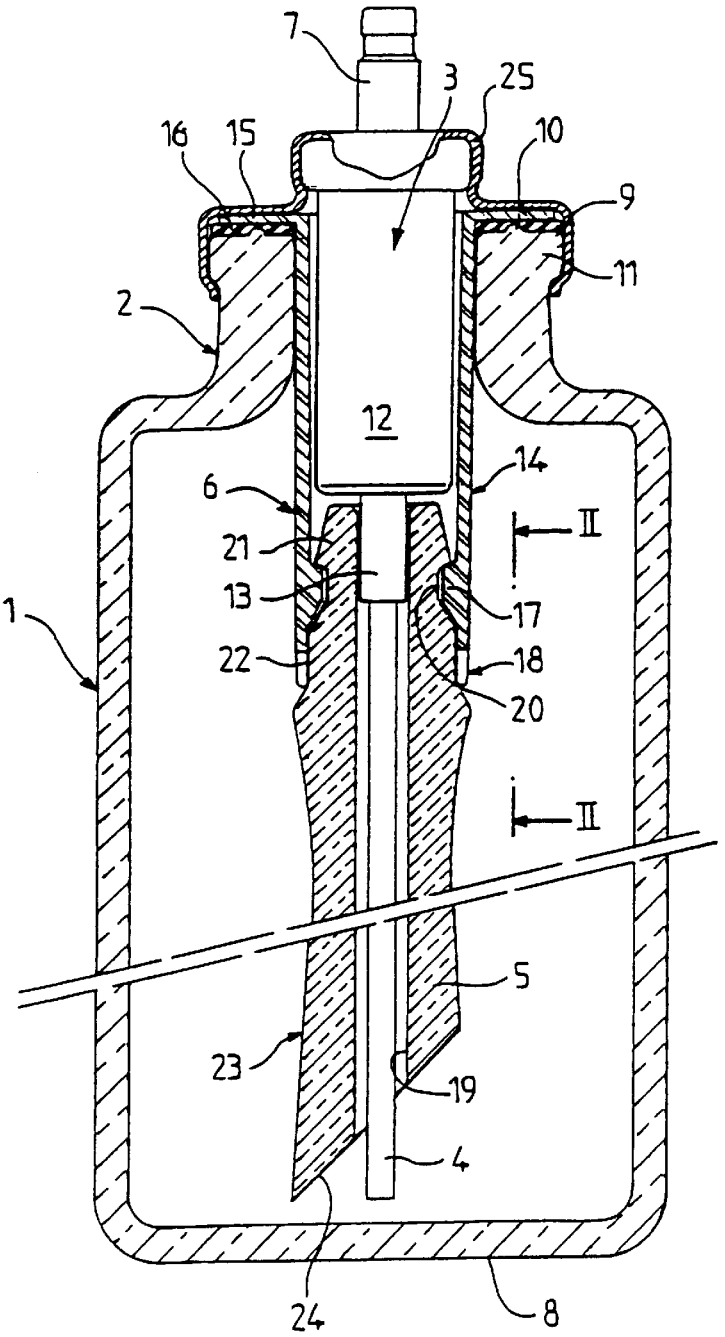

DISTRIBUTION RECEPTACLE FOR A FLUID PRODUCT COMPRISING A BOTTLE EQUIPPED WITH A DISTRIBUTION DEVICE CONNECTED TO A DIP TUBE

This invention relates to a receptacle for the distribution of a fluid product comprising a bottle on which a distribution device provided with a dip tube is fitted.

In known manner, the bottle for this type of receptacle includes a neck on which the distribution device is usually fitted by crimping. The receptacle may be designed for distributing an aerosol and in this case it will contain a pressurized gas, and the distribution device will then be a valve. However, when the bottle is at atmospheric pressure, the distribution device is usually a manual pump with an air intake so that the inside of the receptacle remains at atmospheric pressure while the fluid is being distributed. The distribution device is usually associated with a distribution head that comprises means of activating the distribution device and to eject the distributed product in the desired form, for example by atomization.

A dip tube feeds the distribution device and is connected in a known manner to the bottom of the distribution device and is immersed in the bottle down nearly to the bottom of the said bottle. The free end of the dip tube is usually close to the bottom of the bottle; the free end of the dip tube may be curved and may rest on the bottom of the bottle. The dip tube may be rigid, for example metallic, but it is usually made of a flexible material, and particularly plastic.

These bottles fitted with a distribution device are widely used in the cosmetic industry, particularly for perfumes. The esthetics of the distribution assembly are extremely important for this type of application. The bottles used are usually made of transparent or at least translucid glass. Therefore the user can see the dip tube through the bottle wall, which reduces the esthetics of the assembly.

To solve this problem and improve the esthetics, the dip tube according to the invention is surrounded by a decorative tube which may have the required esthetic effect. The only constraint is that a longitudinal hole must be provided along the length of the decorative tube, inside which the dip tube can be inserted. The outside surface of the decorative tube may have any required geometric shape, or it may be the shape of a figure such as a fruit, animal or human silhouette, and it may be decorated with patterns. The decorative tube may be transparent or opaque, and it may or may not be colored.

Therefore this invention combines two elements, namely a transparent or translucid bottle and a decorative tube through which the dip tube extends. The fact that the bottle is transparent or translucid is important, since otherwise the decorative tube would be useless since its only function is esthetic.

A different design is described in document DE-37 10 788 describing an atomizer comprising a compressible receptacle known as a "squeeze bottle". This atomizer is fitted with a two-phase distribution head and a dip tube which extends into the squeeze bottle. The dip tube is surrounded by a rigid tube, the only purpose of this tube being to protect the dip tube when the receptacle is squeezed.

This type of atomization with a squeeze bottle is preferred for household products for which esthetics is not of overriding importance. The receptacle does not need to be transparent or translucid, and often it is better if it isn't. The tube that surrounds the dip tube is rigid in this case, since it performs a protection function.

This is not the case at all in this invention since the bottle is usually made of transparent glass, and is therefore non-deformable. Therefore, the decorative tube may even be flexible.

As explained above, the distribution device may be a valve when the bottle is pressurized, or an air intake pump when the bottle is at atmospheric pressure, the said air intake maintaining pressure in the bottle while the product is being distributed.

The dip tube may be rigid, but it is preferably made of a flexible material such as polyethylene. In this case the dip tube is advantageously fixed in a known manner by elasticity, either inside a connecting tube projecting towards the inside of the bottle from the bottom of the valve body or the pump body, or outside the connecting tube.

The decorative tube may be made of a flexible material. Preferably, it is made of a rigid material and particularly a rigid plastic or glass.

The decorative tube may be fixed by welding or gluing onto the dip tube. This attachment method is particularly suitable for the case in which the decorative tube is made of a flexible material, and more particularly when the dip tube is rigid.

The decorative tube is preferably fixed using an intermediate part inserted in the neck of the bottle. This part preferably comprises a collar supported on the edge of the neck and a cylindrical skirt that enters into the said neck and comprises attachment means close to its end opposite the collar, that cooperate with complementary attachment means placed close to one end of the decorative tube. This attachment device is particularly suitable for the case in which the decorative tube is made of a rigid material, for example glass.

The decorative tube may be placed outside the cylindrical skirt of the intermediate part. Preferably, it is placed inside this part, and in this case according to one advantageous embodiment, the attachment means fixed onto the cylindrical skirt of the intermediate part consist of a continuous or discontinuous rim located on the inside of the cylindrical skirt, these means cooperating with a complementary shaped groove formed at one end of the decorative tube and on its outside surface.

Advantageously, the end of the cylindrical skirt on which the attachment means are fitted is provided with a free edge on which strips are fitted and which act as springs. These strips bear on the outside surface of the decorative tube. They guide the decorative tube while it is being inserted inside the skirt of the intermediate part, and make its attachment flexible to a certain extent.

The diameter of the longitudinal hole through the decorative tube may be the same as the outside diameter of the dip tube so that it can be inserted by force into the hole. This embodiment is advantageous when the decorative tube is glued or welded onto the dip tube.

However, preferably the diameter of the hole is greater than the outside diameter of the dip tube. It is thus easier to put the decorative tube onto the dip tube, and enables some clearance of the dip tube inside the decorative tube. In this case, there must be a free interval over the entire length of the hole through the decorative tube. The distribution device may be fitted with a connecting tube at its bottom facing the bottom of the bottle, connecting the dip tube to the distribution device; in this case the diameter of the hole in the decorative tube could be greater than the outside diameter of the connecting tube. If the dip tube is fixed inside the connecting tube projecting from the bottom of the distribution device and the diameter of the hole through the decorative tube is greater than the outside diameter of the connecting tube, or if at least part of the diameter is greater than the diameter of the connecting tube, this will avoid the formation of a low pressure area inside the hole through the decorative tube.

For esthetic reasons, the decorative tube preferably covers most of the length of the dip tube until near its end.

Advantageously, the end of the dip tube near the bottom of the bottle is free over a certain length to facilitate suction of the product, and particularly when there is not much product remaining in the bottle. The end of the decorative tube may be cut with a bevel for this purpose.

Preferably, a sealing washer is placed between the collar of the intermediate part and the edge of the neck. An annular projection is then advantageously formed on the edge of the neck. This projection improves the seal when the sealing washer is compressed, due to compression of the sealing washer at the projection. The distribution device (pump or valve) is fixed by crimping or screwing onto the bottle neck. In this case, crimping or screwing is preferably controlled by a dish that covers the distribution device and the neck so as to hold the collar in place and compress the sealing washer. The neck advantageously has an annular projection on its external surface, through which the crimping can be anchored.

The pump or valve preferably comprises a hollow projecting rod through which the product is taken out and through which the valve or pump is activated. However, other types of pump or valve outlets may be used.

The following description of one embodiment of the invention, given as an illustrative and non-restrictive example, will help to obtain a better understand of the invention with reference to the attached drawing.

Figure 2:
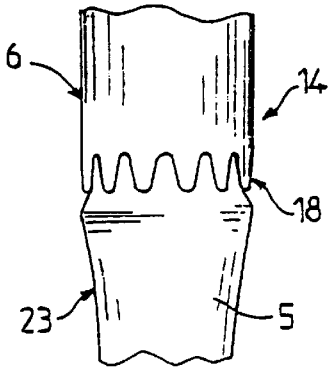

On this drawing:

FIG. 1 is a longitudinal section of a view of a distribution assembly according to the invention, and FIG. 2 is a detail view along line II—II.

The receptacle according to the invention shown in FIG. 1 comprises a bottle 1 containing a liquid to be distributed, the said bottle being provided with a neck 2. A manual air intake pump assembly denoted 3 is placed in the neck 2 and comprises a dip tube 4. A decorative tube 5 is fixed around the dip tube 4 by means of an intermediate part 6.

The shape of bottle 1 is cylindrical, but obviously it may be in any shape such as oval, prismatic or other. The bottle 1 is made of a transparent or translucid material, for example glass; it is provided with a cylindrical neck 2, the side walls of the bottle being connected to the neck 2 through a shoulder. Bottle 1 is closed by a bottom 8 on the side opposite the neck 2. The edge 9 of the neck 2 consists of a plane annular surface on which an annular projection 10 is formed centered on the centerline of the bottle. In its upper part, the neck 2 is fitted with a peripheral rim which forms an outwards projection on the outside surface of neck 2. The inside surface of the neck 2 is cylindrical.

Pump 3 is a conventional manual air intake pump, for example of the type marketed by the "Valois" company as reference VP3 or VP4. It comprises a pump body 12, the bottom of which is provided with an opening connected to a connecting tube 13. The pump piston is connected to a hollow projecting rod. 7 that is used partly as the outlet for the liquid to be distributed, and for activation of pump 3 when it is pushed inwards. In a known manner, the projecting rod 7 is fitted with a distribution head (not shown) on which a spray nozzle is fitted, the distribution head activate the projecting rod, and consequently the pump, by pushing it inwards.

In the embodiment shown, the dip tube 4 is made of flexible plastic. It is force fitted inside the connecting tube 13.

The intermediate part 6 is composed of a cylindrical skirt 14, the outside diameter of which is the same as the inside diameter of neck 2, plus the necessary clearance. At one of its ends, skirt 14 is fitted with a plane annular collar 15 extending outwards perpendicular to the centerline of skirt 14. The outside diameter of this collar is equal to the outside diameter of the edge 9 of neck 2. The annular collar 15 bears on the surface of the edge 9 of neck 2 through a sealing washer 16 the same size as the surface of edge 9. The other end of skirt 14 is fitted with a continuous trapezoidal rim 17 located on the inside surface of the skirt and projecting towards the inside of the skirt. The free edge of skirt 14 is cut so as to form longitudinal strips 18 laid out at regular intervals. According to the embodiment shown in FIG. 2, these strips have a rounded shape, but they could be of any other shape, for example rectangular. The intermediate part 6 is made of an opaque plastic material, for example polyethylene or polypropylene.

The decorative tube 5 is made of a rigid material, for example glass in the embodiment shown in the figures. A longitudinal cylindrical hole 19 is formed along the length of this decorative tube 5. The diameter of this hole 19 is greater than the diameter of the connecting tube 13 along its entire length, and the dip tube 4 fits elastically inside the connecting tube to form a space through which air can circulate when air is being sucked in by the pump and to prevent the formation of a low pressure area in the hole. A groove 20 is provided on the outside surface of decorative tube 5 at one of its ends, the shape of the radial cross section of this groove corresponding to the shape of the rim 17 on the intermediate part 6. The shape of the outside surface 21 beyond the groove 20, on the side facing the pump is tapered, which facilitates assembly. On the other side of the groove 20, the surface includes a cylindrical part 22 with which the strips 18 of the intermediate part come into contact. Over its remaining length 23, the decorative tube 5 may have any arbitrary aesthetic shape. The end of the decorative tubes 5 opposite pump 3 terminates in a bevel 24; in this way, the end of the dip tube projects outside the decorative tube. This arrangement facilitates entry of the liquid to be distributed into the dip tube, particularly when the liquid level is low.

In the embodiment shown, skirt 14 of intermediate part 6 covers part of the decorative tube; only part 23 of the decorative tube, in other words the part with an esthetic shape, can be seen through the wall of bottle 1.

Pump 3 is clamped onto neck 2 by a metal dish 25. The dish 25 covers the peripheral edge 11 of the neck 2 and the outside surface of the pump body 12; it holds the collar 15 of the intermediate part 6 in place by compressing the sealing washer 16 to provide a seal at the annular projection 10; the dish 25 is held in place by crimping its edge below the peripheral edge 11.

What is claimed is:

1. Distribution receptacle for a fluid product comprising a bottle provided with a neck on which a distribution device is fitted, the said distribution device being provided with a dip tube that extends towards the bottom of the bottle to supply liquid to the distribution device characterized in that the bottle is made of a transparent or translucid material and in that the dip tube is surrounded by a decorative tube over at least part of its length, a longitudinal hole being formed through the decorative tube through which the said dip tube passes, the decorative tube being fixed using an intermediate part inserted into the neck of the bottle, the intermediate part comprising a collar that bears on the edge of the neck, and a cylindrical skirt that penetrates into the neck and is provided with attachment means on its internal surface close to the end opposite the collar that can cooperate with complementary attachment means provided close to one end of the decorative tube.

2. Receptacle according to claim 1, characterized by the fact that the attachment means supported by the cylindrical skirt consist of a rim located on the inside of the said cylindrical skirt, these means cooperating with a groove formed at one end of the decorative tube, on its outside surface.

3. Receptacle according to claim 1, characterized by the fact that the end of the cylindrical skirt on which attachment means are fitted, has a free edge equipped with strips.

4. Receptacle according to claim 3, characterized by the fact that a sealing washer is placed between the collar of the intermediate part and the edge of the neck, the collar (15) being held in position on the edge by crimping a dish that covers the distribution device and the neck.

5. Receptacle according to claim 4, characterized by the fact that an annular projection is provided on the edge of the neck to improve the seal due to compression of the washer forming the seal at the projection after the dish has been crimped.

* * * * *